US005895872A

United States Patent [19]

Chase

[11] Patent Number: 5,895,872

[45] Date of Patent: Apr. 20, 1999

[54] COMPOSITE STRUCTURE FOR A STRINGED INSTRUMENT

[76] Inventor: Douglas S. Chase, P.O. Box 21, Bethel, Vt. 05032

[21] Appl. No.: 08/704,380

[22] Filed: Aug. 22, 1996

[51] Int. Cl.[6] ..... G10D 3/00

[52] U.S. Cl. ..... 84/291; 81/293; 81/267; 81/452 P; 81/452 R

[58] Field of Search ..... 84/291, 293, 267, 84/452 P, 452 R

[56] References Cited

U.S. PATENT DOCUMENTS

| | | | |
|---|---|---|---|
| 198,556 | 12/1877 | Abraham . | |
| 337,337 | 3/1886 | Klueber . | |
| 454,905 | 6/1891 | Geiger . | |
| 462,554 | 11/1891 | Hines . | |
| 490,213 | 1/1893 | Owen et al. . | |
| 497,939 | 5/1893 | Abelspies . | |
| 500,581 | 7/1893 | Ingersoll . | |
| 519,416 | 5/1894 | Turner . | |
| 538,679 | 5/1895 | Howe . | |
| 2,585,661 | 2/1952 | Kluson . | |
| 2,597,154 | 5/1952 | Maccaferri . | |
| 2,737,842 | 3/1956 | Polfuss . | |
| 2,793,556 | 5/1957 | Maccaferri . | |
| 3,186,288 | 6/1965 | Finch . | |
| 3,474,697 | 10/1969 | Kaman . | |
| 3,699,836 | 10/1972 | Glasser . | |
| 3,724,312 | 4/1973 | Yamada et al. . | |
| 3,880,040 | 4/1975 | Kaman . | |
| 3,911,778 | 10/1975 | Martin . | |
| 4,084,476 | 4/1978 | Rickard . | |
| 4,090,427 | 5/1978 | Kaman . | |
| 4,119,009 | 10/1978 | Kaman II . | |
| 4,144,793 | 3/1979 | Solka et al. | 84/293 |
| 4,145,948 | 3/1979 | Tuirner . | |
| 4,161,130 | 7/1979 | Lieber . | |
| 4,185,534 | 1/1980 | Cove . | |
| 4,188,850 | 2/1980 | Kaman II . | |
| 4,213,370 | 7/1980 | Jones . | |
| 4,290,336 | 9/1981 | Peavey . | |
| 4,291,606 | 9/1981 | Lepage . | |
| 4,313,362 | 2/1982 | Lieber . | |
| 4,334,452 | 6/1982 | Morrison III et al. . | |
| 4,353,862 | 10/1982 | Kaman, II . | |
| 4,359,923 | 11/1982 | Brunet . | |
| 4,359,924 | 11/1982 | Brunet . | |
| 4,364,990 | 12/1982 | Haines . | |
| 4,408,516 | 10/1983 | John . | |
| 4,510,837 | 4/1985 | Keller . | |
| 4,836,076 | 6/1989 | Bernier . | |
| 4,846,039 | 7/1989 | Mosher | 84/293 |
| 4,856,403 | 8/1989 | Davis . | |
| 4,873,907 | 10/1989 | Decker et al. | 84/291 |
| 4,950,437 | 8/1990 | Lieber . | |
| 4,951,452 | 8/1990 | Chen . | |
| 4,969,381 | 11/1990 | Decker, Jr. et al. . | |
| 5,171,616 | 12/1992 | Dejima | 84/291 |
| 5,171,926 | 12/1992 | Besnainou et al. . | |
| 5,189,235 | 2/1993 | Fishman et al. | 84/291 |
| 5,333,527 | 8/1994 | Janes et al. . | |
| 5,602,355 | 2/1997 | Lipp | 84/422.4 |
| 5,616,873 | 4/1997 | Fishman et al. | 84/293 |

*Primary Examiner*—William M. Shoop, Jr.
*Assistant Examiner*—Kim Lockett
*Attorney, Agent, or Firm*—Samuels, Gauthier & Stevens

[57] ABSTRACT

A composite structure for a stringed musical instrument or an acoustic guitar. The stringed instrument structure having a one piece neck and body cast of a fiber reinforced single resin matrix. Encapsulated are continuous longitudinal fibers which extend distal to the bridge and nut, encircle the periphery of the neck, intermediately connect the peripheral matrix, and which surround the longitudinal fibers integral with the body and head of the instrument. The acoustic guitar having a fiber reinforced single resin matrix, of which the acoustic chamber is not integral to the region below the playing surface such that the neck does not increase in overall depth until the end of the playing surface.

4 Claims, 5 Drawing Sheets

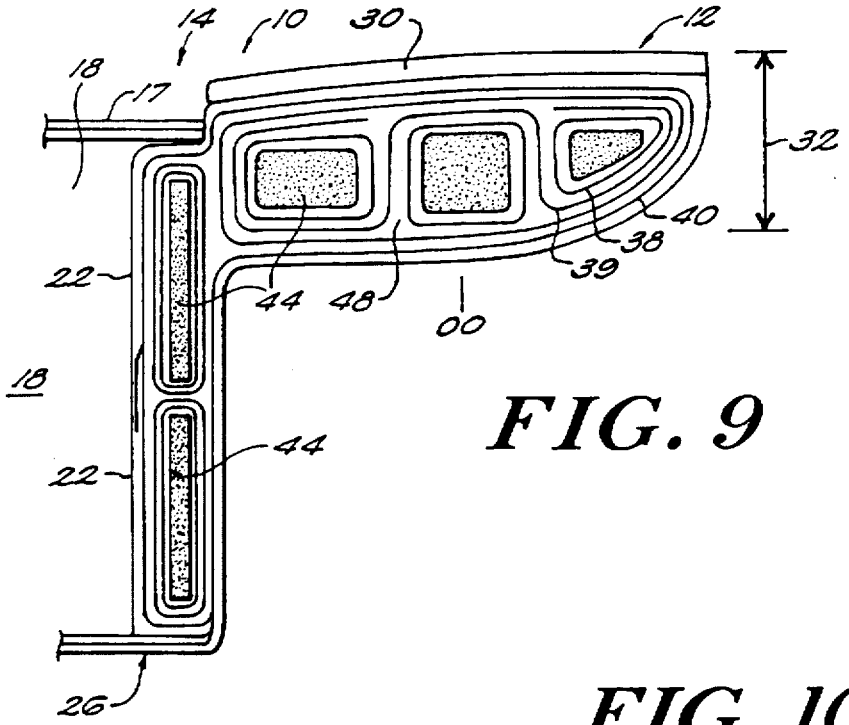
FIG. 9
FIG. 10
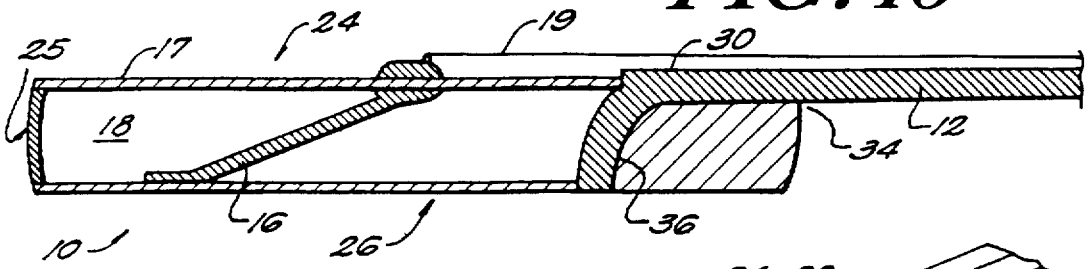
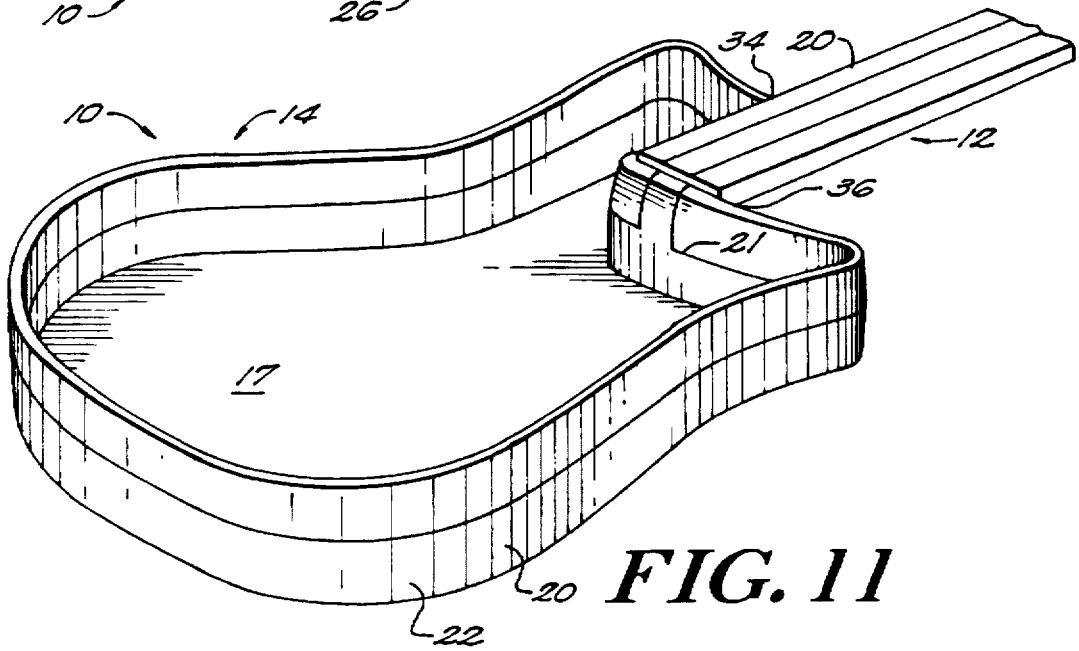
FIG. 11

COMPOSITE STRUCTURE FOR A STRINGED INSTRUMENT

BACKGROUND OF THE INVENTION

1. Field of the Invention

The invention is directed to carbon fiber composite musical instruments.

2. Description of the Prior Art

Traditionally, instruments constructed of wood, have incorporated mechanical means, glues lamination or combinations thereof to affix separate structural pieces together. All of these methods are known to affect the tone of the instrument.

The focus in composite stringed instrument construction has been to emulate the frequency distribution of traditional wooden instruments while benefiting from the structural stability of composite materials, efficient production methods of molded construction, or both.

Composite construction has primarily utilized carbon fiber as the resin reinforcement fiber of choice, largely due to the high strength to weight ratio, the high modulus of elasticity and the low coefficient of thermal expansion. It is known that continuous carbon fibers are stronger and more durable than the bonds of glue, lamination, integrally molded dissimilar materials, a resin matrix without reinforcement of continuous fibers, and of mechanical means of affixation. Also, continuous fibers conduct energy to a higher degree than an abrupted medium, and thus both energy reflection and dissipation decrease accordingly.

A problem with achieving the ideal traditional sound of wood with a carbon fiber reinforced resin matrix is partially due to the relatively lower degree of energy absorption. The lower degree of energy absorption is desirable for sustain qualities and harmonic clarity yet it is undesirable due to the relative excess in high frequencies. This characteristic has been addressed by utilizing dampening materials such as cardboard, wood, and aramid to lower the ratio of high to low frequencies and to conduct force with respect to auditory dispersion in a manner closer to the traditionally preferred wood.

Additional factors affecting tone quality in composite construction are resin to fiber ratio, fiber orientation, resin type, resin cure temperature, preload fiber tension, fiber modulus of elasticity, area and unit density, as well as, a multitude of structural functions.

Some prior art has eliminated the use of wood due to inevitable structural variabilities and inconsistencies Thermal expansion and contraction as well as long term structural changes, such as creep and drying, also affect tone and strength. These variances when integrated with dissimilar materials can also bring rise to delamination or other structural failure.

It is common for the shape of composite acoustic guitars to replicate the traditional acoustic guitar shape. A standard shaped guitar includes an increase of the depth under the fretboard at the junction of the acoustic chamber with the heal of the neck which is approximately at the 14th fret This limits the access of the upper register, the 12th to a possible 24th fret, as it overlaps the sound chamber. The introduction of the "cutaway", a removal of the sound chamber portion adjoining the overlap, has improved access of the upper register, yet the neck design has remained unchanged The traditional increase in depth under the playing surface with a heal at the junction of the body has remained a constant. Thus, the heal and the acoustic chamber integral to the underside of the playing surface mandate a varied playing form in the transition from the lower register to the upper register.

Traditional acoustic guitar bracing provides soundboard reinforcement for string tension support. The braces are generally lengths of wood glued to the underside of the soundboard in a diverse variety of patterns. In the construct of an arch top guitar, a tailpiece is additionally implemented. Traditional violin construct, typically provides string tension support by means of a length of wood glued to the underside of the upper soundboard along the longitudinal axis relative to the bridge, a tailpiece, a bridge, and a sound post. Additional strength is inherent in the curvature and varied thickness of the soundboards. Composite acoustic construction has emulated the traditional processes.

A primary objective of the present invention is to provide a composite structure for use as a stringed instrument neck and body formed of a cast of a fiber reinforced single resin matrix including means for attaching tuning keys, a nut, a fretboard, amplification means, and a bridge.

Another objective of the present invention is to provide a composite structure for an acoustic guitar, wherein access is provided to the upper register, unobstructed by a heal or an acoustic chamber of traditional form as the acoustic chamber is not integral to the region below the playing surface.

Still, another objective of the present invention is to provide a composite guitar having a neck and body structure which includes a plurality of integral tubes and having a fiber orientation of two or more helically wound tubes integral within a helically wound tube.

SUMMARY OF THE INVENTION

In accordance with the present invention is provided a composite structure for use as a stringed instrument neck and body formed of a cast of a fiber reinforced single resin matrix. Provided by the structure are means for attaching tuning keys, a nut, a fretboard, amplification means, and a bridge.

In accordance with the present invention is provided a composite structure for an acoustic guitar, wherein the acoustic chamber is not integral to the region below the playing surface such that the neck does not increase in overall depth until the end of the playing surface. Thus, access is provided to the upper register, unobstructed by a heal or an acoustic chamber of traditional form.

Also provided, in accordance with the present invention is the structure of a single resin matrix encapsulating continuous longitudinal fibers which extend distal to the bridge and nut, which encircle the periphery of the neck, which intermediately connect the peripheral matrix, and those which surround the longitudinal fibers integral with the body of the instrument.

Additionally there is provided a neck and body structure for a composite guitar incorporating a plurality of integral tubes. Further provided, is a fiber orientation of two or more helically wound tubes integral within a subsequently wound helical tube. Inherent of this form are continuous fibers which extend distal to the nut and the bridge, as well as, interconnect the peripheral orientation intermediately.

In accordance with the present invention is provided a soundboard brace for use as an internal tension support element in the construction of an acoustic guitar, which contacts the underside of the soundboard at an area relative to the bridge and extends to one or more points of the body, the apposing soundboard, or both. And preferably utilizing the sidewall for longitudinal support and the apposing soundboard for lateral support.

In accordance with the invention is provided an integral soundboard, bridge, and brace structure cast of a fiber reinforced single resin matrix, for use as an amplification, string alignment, and string tension support element of an acoustic guitar. Preferably a planar form of a soundboard of carbon fiber is layered or commingled with aramid as well as an integrally molded continuous fiber brace which passes through the planar layer to the form of the bridge.

BRIEF DESCRIPTION OF THE DRAWINGS

FIG. 9 is a cross section of a plural tube at a tube neck;

FIG. 10 is a side sectional view of an acoustic peripheral plural tube;

FIG. 11 is a perspective top view of a peripheral acoustic plural tube;

DETAILED DESCRIPTION OF PREFERRED EMBODIMENT

Figure 1:
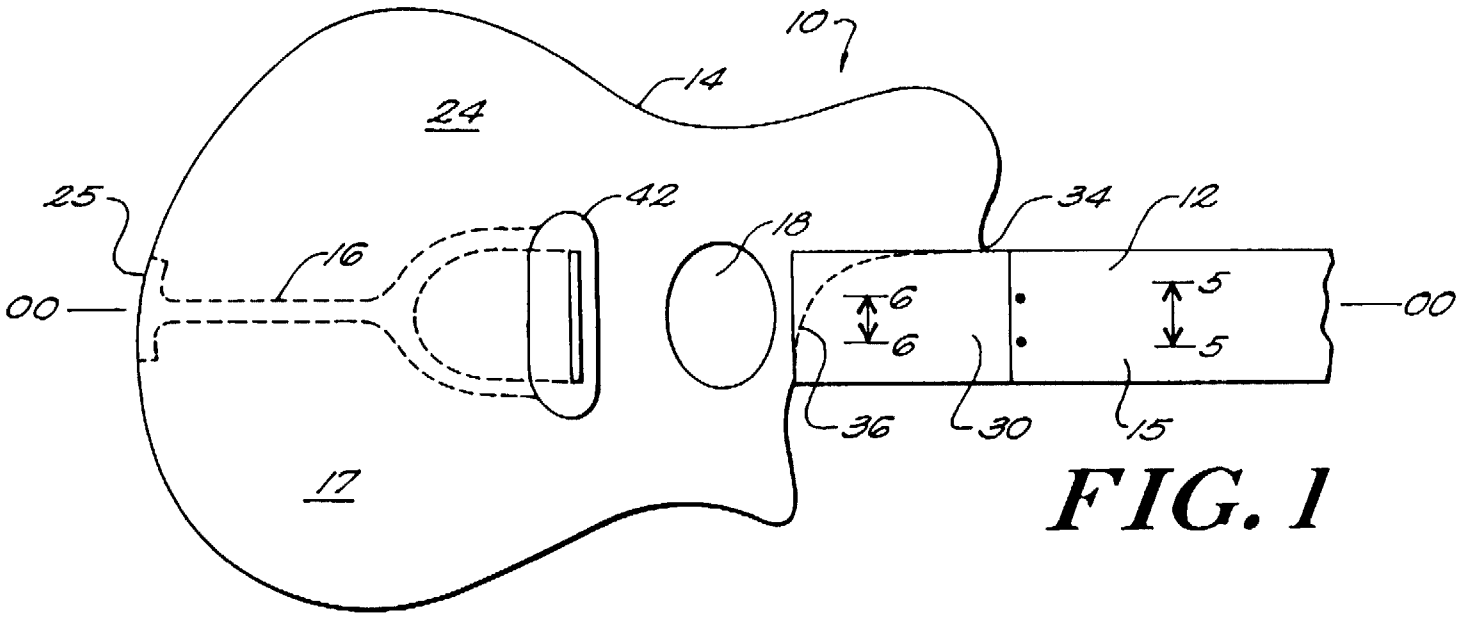
FIG. 1 is a front view of an acoustic guitar in accordance with the invention.
Figure 2:
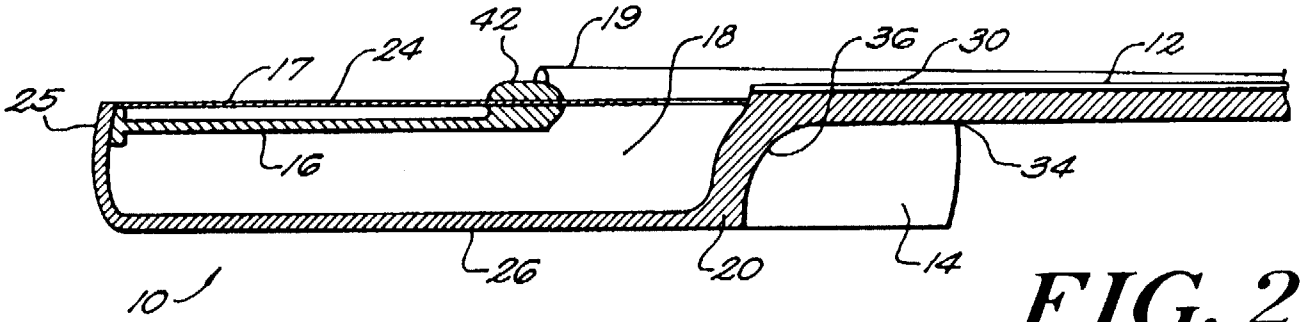
FIG. 2 is a partial side cross view in accordance with the present invention.

Referring initially to FIGS. 1 and 2, an acoustic guitar in accordance with the present invention is shown at 10. The guitar has an integral neck 12 and body 14 cast of a fiber reinforced single resin matrix. Specifically, FIG. 1 illustrates the absence of a heal and acoustic chamber 18 integral beneath the fretboard 30 An acoustic chamber 18 is formed of the sidewall 22 of the body 14 and the. soundboards 17. Additionally, the soundboards 17 are integrated to the sidewall 22 at the front 24, the back 26, intermediately 28 or a combination thereof, by mechanical means, glue, or integral molding. The soundboards 17 are alternatively wood, fiber reinforced resin, or a combination thereof.

Figure 3:
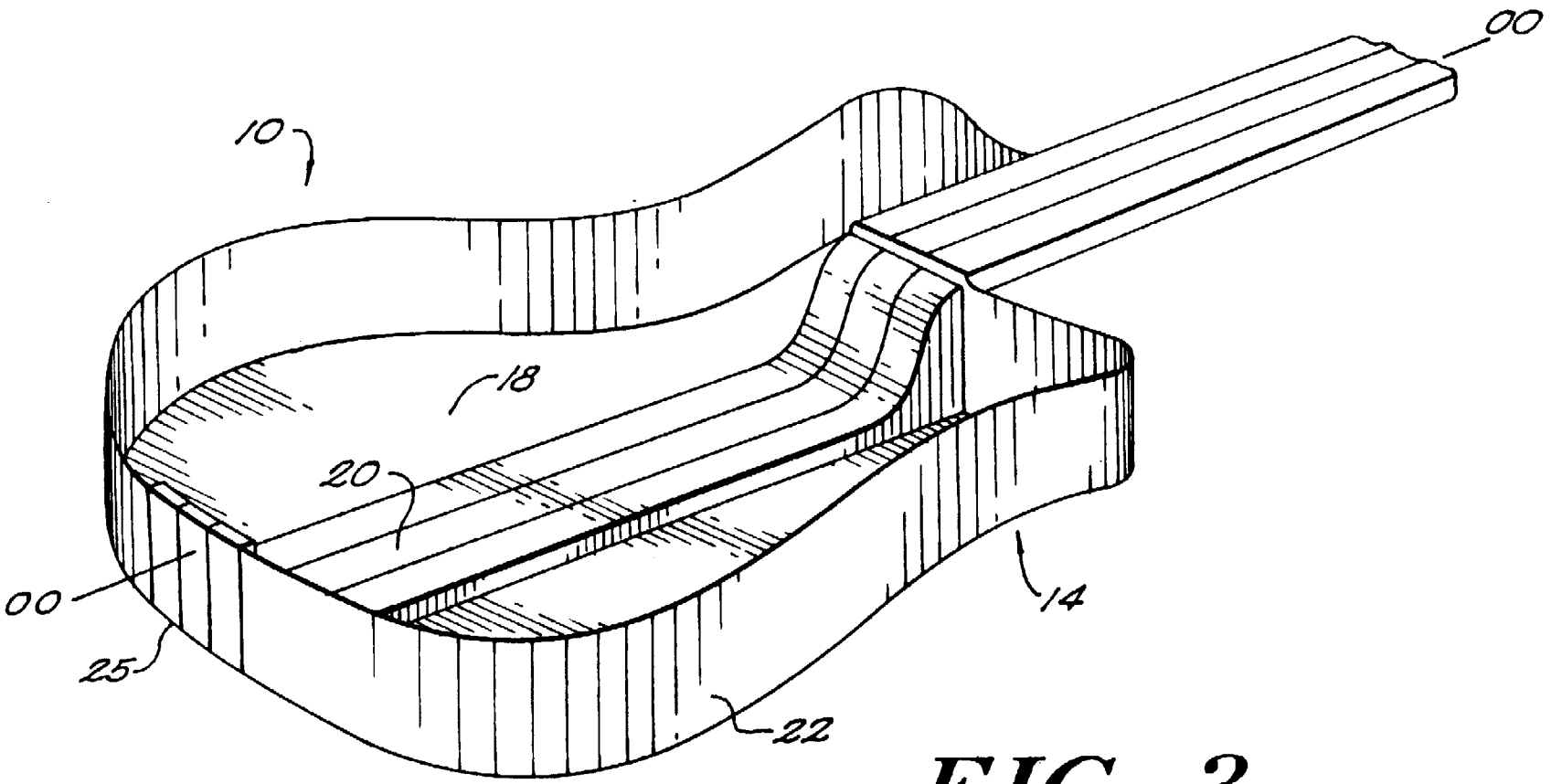
FIG. 3 is a perspective view of a lower medial acoustic plural tube.

FIGS. 2 and 3 illustrate a plural tube which is positioned along the neck to the back 26 of the acoustic chamber 18, and up along the end wall 25, the plural tube is also surrounded by fibers.

Figure 6:
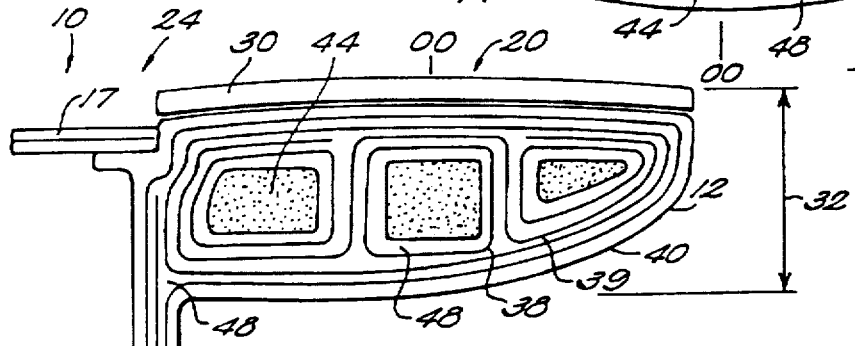
FIG. 6 is a cross sectional view of a plural tube neck taken along line 6—6 of FIG. 1.

Another feature of the acoustic guitar structure is further illustrated in FIGS. 6 and 9, the acoustic chamber 18 is not in the region below the playing surface 30. The depth of the neck 32 does not increase at the traditional junction 34 of the body 14 with a heal. The increase is at the end 36 of the playing surface 30. Thus, benefit is provided in unobstructed access to the playing surface 30 of the $2^{nd}$ octave, the $12_{th}$ fret 15 up from 34 to 36.

Figure 5:
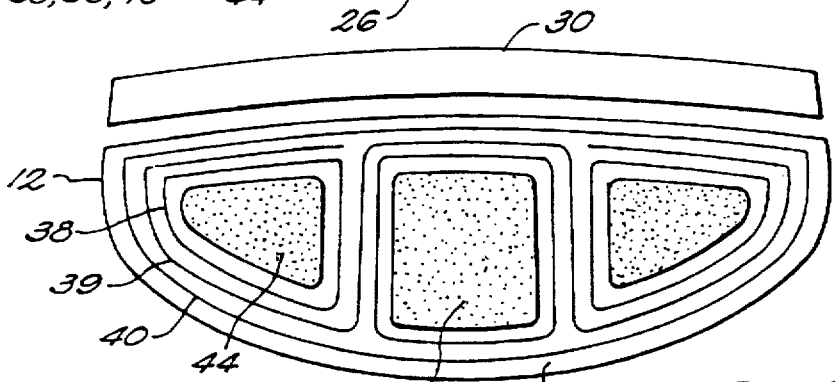
FIG. 5 is a cross sectional view of a neck along line 5—5 of FIG. 1.
Figure 12:
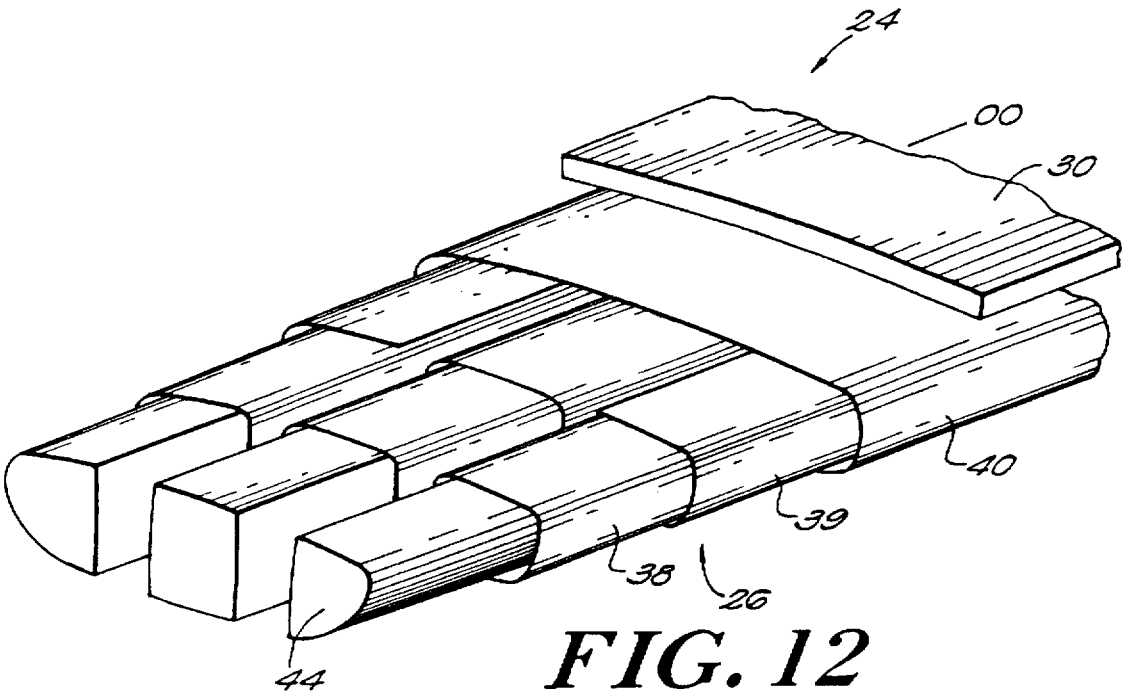
FIG. 12 is a telescoped perspective cross section of a plural tube structure.

Further illustrated in FIGS. 5 and 12 are the continuous fibers in the form of helically wound tubes 38, 40 which extend distal to the nut and the bridge 42, as well as, interconnect opposing sides of the structure. Specifically illustrated in the neck 12, is the extension from the front 24 to the back 26. In accordance with the invention, the structure of integral tubes 38, may continue through the body as a singular unit or alternatively bifurcate 21 to form a plurality of integral plural tubes 20, (see FIG. 11). FIG. 6 is a cross sectional view of line 6—6 of FIG. 1 as embodied in FIG. 31, wherein the plural tubes are integral to the rear of the acoustic chamber. FIG. 9 is similar to FIG. 6 and as embodied in FIG. 11 wherein the plural tubes bifurcate 21 and are integral with the sidewall 22.

Figure 13:
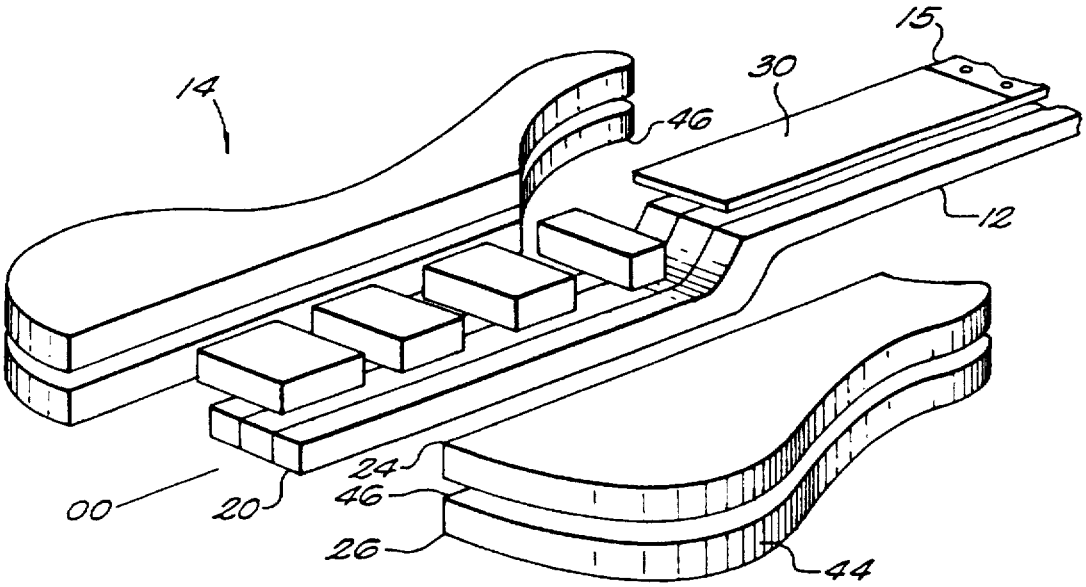
FIG. 13 is an exploded view of a core for a composite structure oriented for electrical amplification.

FIG. 13 illustrates an embodiment of an electric guitar. Specifically illustrated is the core 44 which functions to assist with the mold to provide structure to the resin impregnated fiber during casting. Included in this structure is the form of plural tubes integral with the neck 12 and body 14. The body is formed of the integral plural tube structure 20 of the neck 12, a fiber layer across the front 24, a fiber layer across the back 26, and a fiber layer intermediately 46. Preferably electronics cavities and titanium or stainless steel bridge mounts are cast into the single matrix.

Referring more specifically to FIGS. 5, 9 and 13, the core is alternatively a composite, a fibrous organic, or a material removable by solute or heat. The inner tubes 38 are formed of composite filaments preferably carbons aromatic polyamide fiber known as Kevlar® (available from Dupont) or both. Additionally, the tubes are alternatively formed of a braided tube, a helical wind, a fabric wrap or a combination thereof.

As shown in FIG. 1, there is a longitudinal axis or center line 00, medial to the nut (not shown) and the bridge 42. The fiber is alternatively comprised of a 75% fiber orientation within 30° relative to the medial axis of the tube with a proportion of 25% of the fiber oriented 90 to 30 degrees relative to the medial axis of tube. The inter tube wrap layer 39 is of a composite weave of carbon or Kevlarg with fiber orientation alternatively 30 to 45 degrees of longitudinal axis 00. The fabric is illustrated extending over the front 24 of the middle tube and is wrapped up and around the adjoining tubes. The outer tube integrally connects the three inner portions by means of similar fiber alternatives and orientations as the inner tubes. All of the described fiber is impregnated with the single resin matrix 48.

Figure 4:
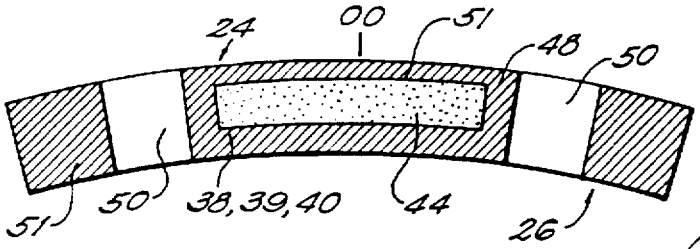
FIG. 4 is a cross sectional view of a head.

FIG. 4 illustrates a cross of a head, wherein the core is an extension of the neck 12 and body 14. The fibers are comprised of continuous fibers 38, 39, 40, which form the neck 12 and body 14, and segmented carbon fibers 51. The tuning key holes 50 are alternatively cast or machined.

Figure 7:
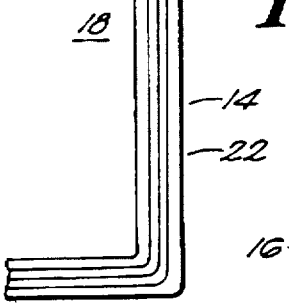
FIG. 7 is a cross sectional view of a subsoundboard brace structure.
Figure 7:
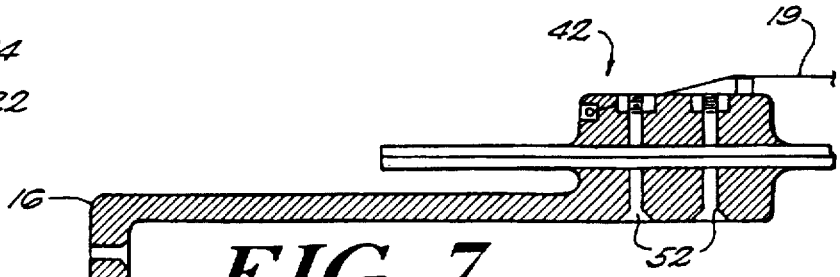
Figure 8:
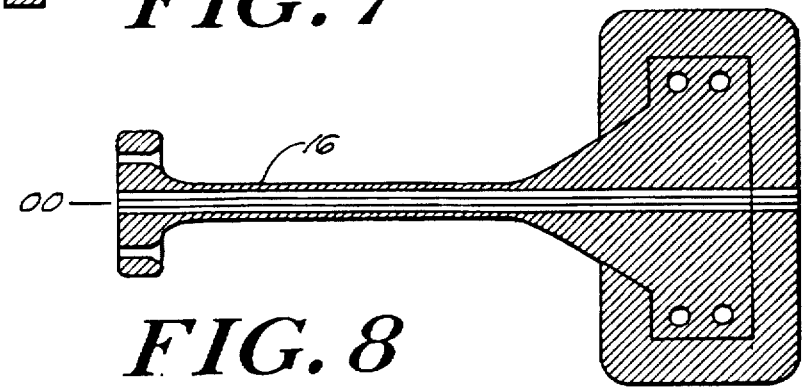
FIG. 8 is a bottom view of a subsoundboard brace structure.

FIGS. 7 and 8, illustrate an embodiment of a soundboard brace structure 16 for an acoustic guitar, oriented to provide support of string 19 tension and displacement energies at the bridge 42, and is preferably cast of a carbon fiber reinforced epoxy resin, wherein continuous fibers extend and to end and pieced carbon fibers reinforce the attachment portions of the unit. The brace 16 is connected to the underside of the bridge 42 preferably by glues mechanical means or both. A preferred embodiment provides longitudinal support by extending to connect to the tail and 25 and at sidewall 22 singularly along the intersection 02 of the plane perpendicular to the soundboard and bisected by the axis 00, as well as, lateral support by extending to connect to the apposing soundboard.

Referring to FIGS. 2 and 10, the bridge 42, the brace 16, and the soundboard 17 are integrally cast of a fiber reinforced single resin matrix. The soundboard consists of alternative layered plys or commingled fiber. The bridge 42 is pieces of fiber tow and the soundboard brace 16, unidirectional tow of form described of FIGS. 7 and 8 which additionally extend through the soundboard 17 and integrally forms the bridge 12. Alternatively the bridge 42 can be cast alone or with a soundboard 17.

In accordance with the features of the present inventions the fiber reinforced single resin matrix composite structure is inclusive of several embodiments differentiated by amplification means and integral plural tube orientation within the body.

Having shown illustrated embodiments, it will be apparent, however, that variations and modifications can be made to the inventions with the attainment of some or all of the advantages. Therefore, it is the object of the claims to cover all such variations and modifications as come within the true spirit and scope of the inventions What is now claimed is:

1. A composite structure for neck and body of a stringed instrument, said instrument having a nut and a bridges said composite structure comprising:

a fiber reinforced single resin matrix having continuous fibers extend distal to both the nut and the bridge, along the circumference of the structure, extend intermediate to the circumferential orientation, and which surround said structure of fiber to form a body portion.

2. A composite structure for a stringed instrument, according to claim 1 said structure further including a plurality of integral helical fiber tubes of continuous fibers extending distal to both the nut and the bridge and extending along the length of circumference of the neck such that a longitudinal projection of a fiber from the nut to the bridge encircles the exterior perimeter of the neck, said continuous fibers extending distal to both the nut and the bridge and extending intermediate to the peripheral orientation, such that a longitudinal projection of a fiber from the nut to the bridge passes between apposing sides of a peripheral orientation a number of times.

3. A composite structure for a stringed instrument according to claim 1, wherein the plurality of integral tubes bifurcate to a plurality of plural integrated tubes integral with the body.

4. A composite structure for a stringed instrument according to claim 1 wherein the fibers are carbon, aramid, or glass.

* * * * *